United States Patent [19]

Francis

[11] 4,037,796

[45] July 26, 1977

[54] ROTARY MILL UTILIZING AN IMPACT REDUCTION CHAMBER AND A VERTICAL AIR FLOW CLASSIFICATION CHAMBER

[75] Inventor: Peter M. Francis, Las Vegas, Nev.

[73] Assignee: Industrial Mining Machinery Company, Las Vegas, Nev.

[21] Appl. No.: 676,477

[22] Filed: Apr. 13, 1976

[51] Int. Cl.[2] ..... B02C 23/12

[52] U.S. Cl. ..... 241/59; 241/79.1; 241/80; 241/189 R

[58] Field of Search ..... 241/19, 24, 27, 30, 241/52, 55, 58, 59, 79, 79.1, 80, 189 R, 194, 275

[56] References Cited

U.S. PATENT DOCUMENTS

| | | | |
|---|---|---|---|
| 529,874 | 11/1894 | Parker | 241/55 |
| 1,231,478 | 6/1917 | Blankmann | 241/189 R |
| 1,469,877 | 10/1923 | Blum | 241/59 |
| 1,570,037 | 1/1926 | Blum et al. | 241/59 |
| 2,931,581 | 4/1960 | Lykken et al. | 241/55 |
| 3,929,293 | 12/1975 | Hahn et al. | 241/79.1 |
| 3,936,004 | 2/1976 | Graf et al. | 241/275 |

*Primary Examiner*—Granville Y. Custer, Jr.
*Attorney, Agent, or Firm*—Herbert C. Schulze

[57] ABSTRACT

A mill for the reduction and classification of ore utilizing an impact rotor to obtain the reduction of large ore chunks and particles by impaction between shatter bars and hammers mounted on the rotor. The shatter bars are mounted on walls of an impact reduction chamber in a position to be impacted by the ore thrown from the impact rotor hammers. Particles are then carried by vertical air flow into vertically stacked classification chambers which are located directly above the impact reduction chamber. Gravity return of the heavier of these particles causes a secondary impact with the impact rotor producing a continuous interchange of particles and resulting in the autogenous attrition of the particles between the rotor and breaker bars. Another feature of the present invention is the utilization of "fluidizer" to maintain the flow of particles which accumulate at the bottom of the impact reduction chamber.

6 Claims, 8 Drawing Figures

18
23
21
23a
A
28c
28a
19a
19
28
25
B
28b
22a
27a
14
15
12
26
22b
C
16
12b
12
12c
80
12a
81
42
17
82
82
41
60
61
75
70
72
44
43
45

ROTARY MILL UTILIZING AN IMPACT REDUCTION CHAMBER AND A VERTICAL AIR FLOW CLASSIFICATION CHAMBER

CROSS-REFERENCE TO RELATED PATENT APPLICATIONS

Previous filing includes U.S. Pat. No. 3,887,141, issued June 3, 1975 for IMPACT-ATTRITION MILL UTILIZING AIR FLOW, and a continuation-in-part titled AUTOGENEOUS IMPACT AIR MILL by Peter M. Francis, et al. Ser. No. 580,988 filed May 27, 1975.

BACKGROUND OF THE INVENTION

1. Field of the Invention

This invention is in the general field of ore milling and is more particularly directed to an impact classification mill wherein the ore is disintegrated by impact between the ore and an impact rotor unit. In the removal of desirable minerals from waste materials in a given ore it is frequently necessary to reduce the raw size of the ore chunks by a multistep reduction process. Furthermore it is frequently necessary to obtain a relatively uniform final particle size for a various concentration whereby the desirable materials are separated. The processes associated with the crushing, milling, discharge, and classification of ore require much labor, resulting in the expenses associated with supporting a substantial labor force at the location of the ore deposit. Also, each of the processes is relatively power intensive resulting in a high power expenditure. Furthermore, for each step in the process the abrasive and impacting forces associated with the reduction of the ore produces a high wear condition, resulting in considerable down time for the machinery, and the expensive replacement parts.

2. Description of the Prior Art

There have been a number of various types of mills available in the past for the use in reduction or ore. Such mills have been in use in the past are primarily directed to crushing and the like, without the reference to upgrading of the mineral classifying function.

Because of the deficiencies of prior art reduction processes various approaches have been proposed, whereby the process of crushing, milling, and classification can be accomplished in a single machine. However, previous prior art devices have failed to provide for sufficient reducing force in conjunction with a device that provides adequate control over the finally reduced product, so that a uniform classified size may be consistently produced. One of the great deficiencies has been a tendency of material to pack in the bottom of the impact reduction chamber. This has been cured in the present invention by the use of a "fluidizer." It is therefore desirable to have an ore reduction mill which combines the functions of crushing, milling and classification in a single housing and with a single drive motor. Such a mill is particularly desirable if the wearing parts of the mechanism are inexpensive, and easily replaced, and if positive control over the final particle size is available.

SUMMARY OF THE INVENTION

In the reduction of ores, for the purpose of removing minerals, it is customary to crush by means of ball mills, jaw crushers, and the like, and thereafter to pass the material thus crushed in to various settling tanks and other classifying apparatus. We have now developed, however, in a single mill, a reduction mill which can reduce particles to a very fine grain size, and at the same time, by means of appropriate air flow can actually classify and up-grade the mineral ores thus crushed, and in this manner reduce the ultimate number of steps required to get maximum and economic ore removal.

An exemplary embodiment of the invention comprises a mill in a single housing. An impact reduction chamber is fed the raw ore with variable particle sizes up to and including chunks on the order of 1 foot in diameter. An impact rotor is positioned within the impact reduction chamber and secured to the output shaft of a drive motor. The impact rotor mounts a plurality of elongated hammer heads around its periphery. The hammer heads are oriented parallel to the rotational axis of the impact rotor. The rotor is positioned so that the ore, falling under the influence of gravity, is tangentially directed against the hammer heads, as the hammer is in the downward mode of travel, and repelled therefrom with great force against the sides of the impact reduction chamber. In the impact zone, within the impact reduction chamber, the walls are lined with a plurality of shatter bars. The shatter bars contain projecting edges which reduce the already impacted ore to a finer particle size. The reduced ore particles fall to the bottom of the chamber and are swept, as they reach a predetermined depth, by the continuous rotation of the impact rotor toward a fine particle outlet.

Classification of particle sizing is achieved in vertically stacked classification chambers in the classification area of the mill, directly above the impact reduction chamber. Each classification chamber will contain a specially designed diverter plate and a cooperative outlet chute. Particle sizing is achieved by the velocity of air in the classification area since lighter particles will be deflected into the upper chambers and heavier particles will be deflected into the lower chambers. Air flow velocity will be controlled by the amount of air entering the air inlets and the revolutions per minute of the impact rotor. Direction of vertical air flow can be regulated by air deflector flaps within the classification chambers.

It is therefore an object of the invention to provide a new and improved impact-classification mill utilizing vertical air flow.

It is another object of the invention to provide a new and improved impact-classification mill which crushes, mills, and classifies ore within a single housing.

It is another object of the invention to provide a new and improved impact-classification mill which makes it practical to produce previously uneconomical ore deposits.

It is another object of the invention to provide a new and improved impact-classification mill with a high power efficiency.

It is another object of the invention to provide a new and improved impact-classification mill with adjustment of the discharged fine particle size.

It is another object of the invention to provide a new and improved impact-classification mill which is relatively low in initial cost.

It is another object of the invention to provide a new and improved impact-classification mill which is relatively simple in construction.

It is another object of the invention to provide a new and improved impact-classification mill which may be used for concentration of gold ore.

It is another object of the invention to provide a new and improved impact-classification mill utilizing control over the vertical air flow as a means of controlling final particle size.

It is another object of the invention to provide a new and improved impact-classification mill wherein the aerodynamically designed impact rotor acts as an air blower.

Another object of this invention is to provide a new and improved impact-classification mill wherein a fluidizer is provided to prevent packing of material within the primary reduction chamber.

Another object of this invention is to feed material tangentially to the impact rotor hammers so that hammer wear will be greatly reduced.

Another object of this invention is to provide vertically stacked classification chambers whose outlet chutes can be positioned in any of four directions and whose outlet chutes contain screens that can be angularly adjusted.

Another object of this invention is to control internal air velocity by controlling impact rotor revolutions per minute and by controlling volume of air entering the air inlets.

Another object of this invention is to control the direction of air flow within the classification chambers by the use of air deflector flaps.

Other objects and advantages of this invention will become apparent to those skilled in the art upon reading the description of a preferred embodiment which follows, in conjunction with a review of the appended drawings.

DESCRIPTION OF A PREFERRED EMBODIMENT

Figure 1:
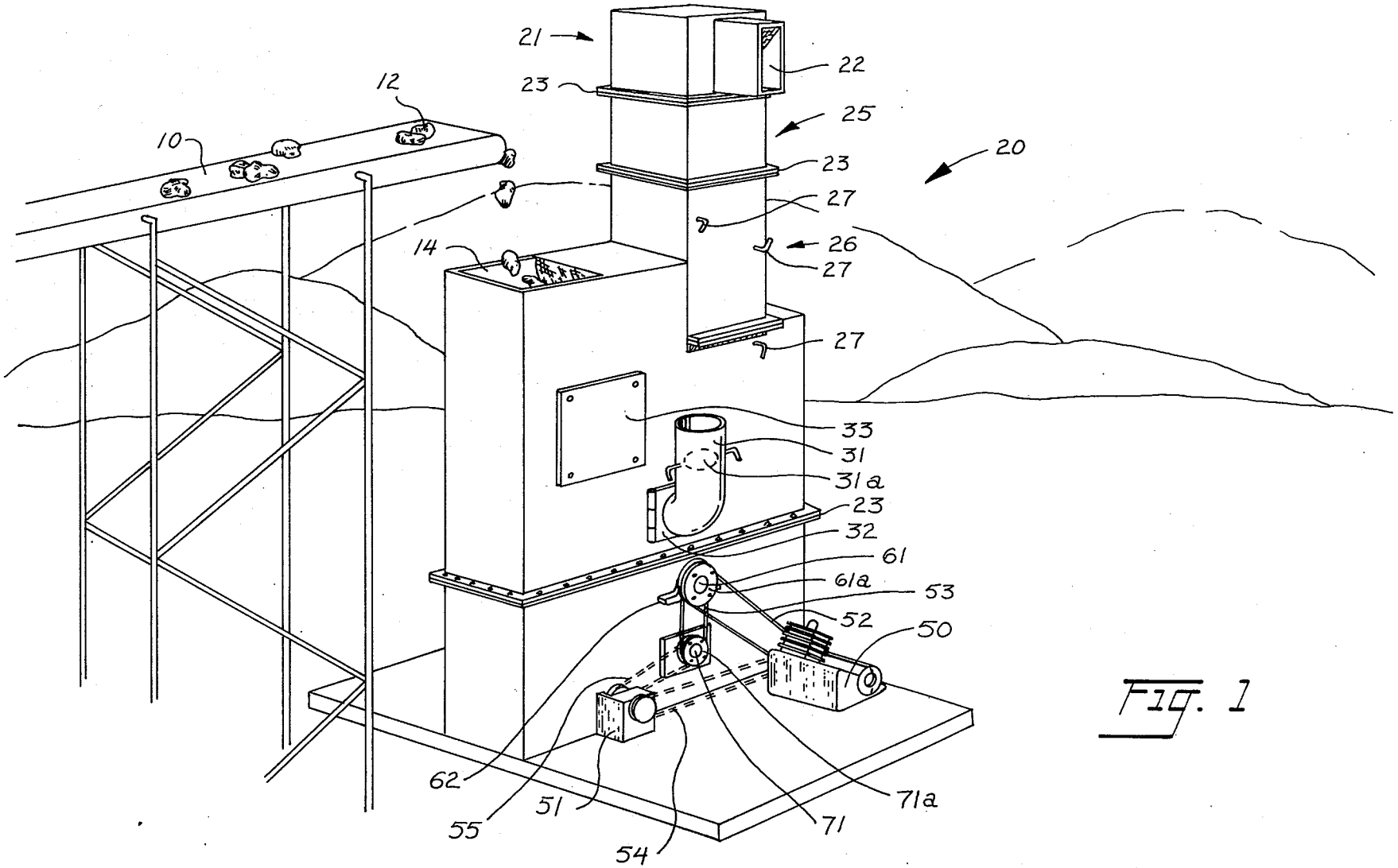
FIG. 1 is a perspective view of the mill.
Figure 2:
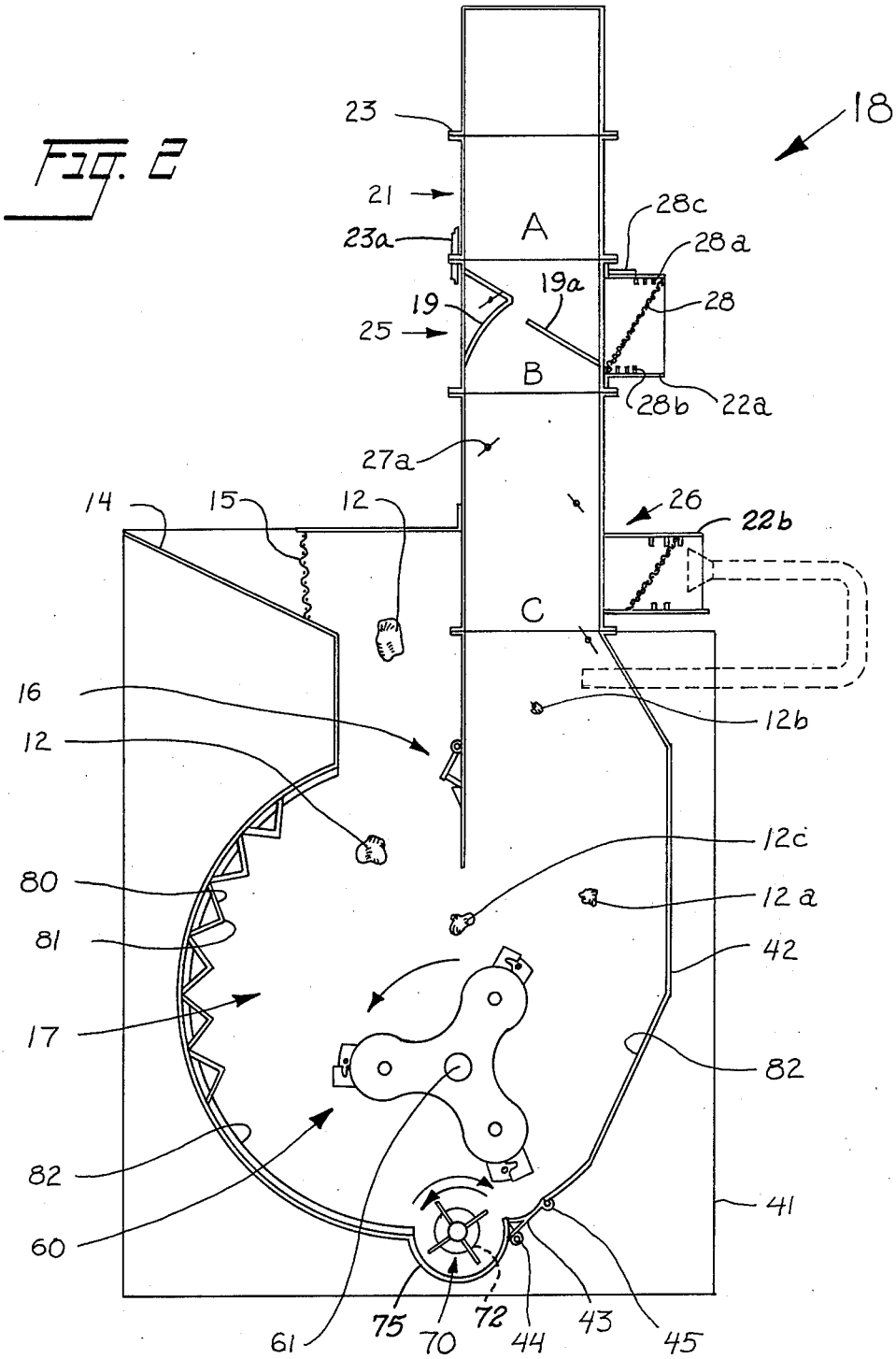
FIG. 2 is a front cross section of the mill.
Figure 5A:
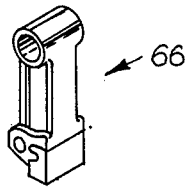
FIG. 5*a* is a perspective view of the hammer of FIG. 5.
Figure 5:
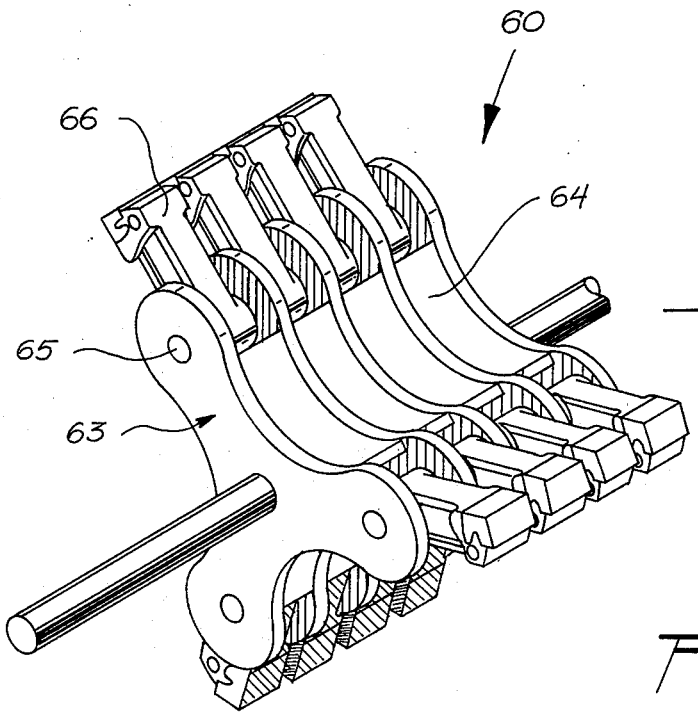
FIG. 5 is an exploded perspective view of the impact rotor used in this embodiment.
Figure 5B:
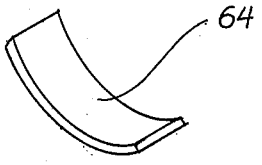
FIG. 5*b* is a perspective of element 64 of FIG. 5.

Referring now to the drawing and particularly to FIGS. 1 and 2, there is illustrated the rotary mill 20 and a conveyor system 10. An ore feed chute 14 comprises a downwardly sloping wall which terminates in a flexible curtain 15 secured at its upper edge. Mounted interiorly of the housing outer wall 41 is an impact rotor 60. The rotor is carried on a shaft 61 which extends transversely across the housing outer wall 41 and penetrates the housing and is carried on bearings 62. In reference to FIG. 5, the impact rotor 60 comprises of a plurality of support elements defined herein as blades 63 and plates 64. The blades and plates are affixed to shaft 61 to increase the strength and rigidity of the unit. Blades 63 are penetrated at their periphery by bores. The bores in adjacent discs are in alignment to receive a removable shaft 65. Commercial hammers 66, such as Esco 802-B-1 are inserted between blades 63 and held in place by removable shaft 65. The shape of blades 63 together with plate 64 cause an air blower configuration so as to highly contribute to the vertical air movement within the mill which is necessary for classification of particle sizes. This point will be more fully explained. In reference to FIGS. 1 and 2, the impact rotor 60 is turned by drive motor 50 in the direction of the arrow to propel ore chunks and particles 12 falling from the feed chute 14 under the influence of gravity. It has been found that tangential feed is important for the reduction of wear on the hammers. Tangential feed is accomplished by using an adjustable diverter 16 to move out into the stream of the material entering the mill and thus cause it to divert from a direct vertical descent to an angularly disposed, circumferential descent so that material entering the mill will do so on a tangent to the direction of the hammer movement in a downward mode.

In the impact reduction chamber 17 there is mounted a plurality of impact plates 80. The impact plates 80 comprise V-shaped channel sections extending transversely of the housing outer walls 41 with their elongated longitudinal axes in parallelism with the rotational axis of the impact rotor 60. So positioned, the impact plates 80 present a plurality of apex proportions 81 to shatter the ore chunks and reduce the particle size. Particles passing the shatter bars and impacting the remainder of the chamber lining wall 42 contact a plurality of lining plates 82. The lining plates 82 could be Easco 803-C type as manufactured and sold by Esco Corporation of 2141 Northwest 25th Ave., Portland, Ore. 97210 under said name.

The shape of trap door 43 is such that it acts as a riffle in a manner similar to a riffle in a sluice-box and by reason thereof the heavier particles or ore collect on the trap door 43 until they build up to a sufficient extent that they are swept, by contact with the hammers 66, and are therefore fed into the stream of airflow. The access door 43 may be utilized for certain ore types, such as gold bearing ore to remove the concentrated ore. Removal is accomplished by swinging the latch portion 44 out of the interference with the door, thereby permitting it to swing free on the hinge 45. Structurally, it will be noted that there is a hinge position such as a customary hinge having a pin inserted through interlinking bearing members, with an elongated curved inner surface of the trap door, and sufficient supporting plate to enable latching by a pin through a hasp like arrangement at 44 or the like. Where it is desired to collect heavier particles which have built up in this area due to their excessive weight and tendency to settle in this deflecting area as is known in the art, the pin may be pulled from the latching arrangement at 44 and the trap door will be lowered about its hinge point 45.

An important feature of this mill is the direct cooperative effect between air velocity and classification of particle sizes. Due to the counter clockwise rotation of the impact rotor 60, particles 12*a*, 12*b* will be propelled upward toward classification chambers 26, 25 and 21. This propulsion is somewhat caused by impact with the hammers but mostly by air flow which is directly controlled by impact rotor rpm and volume of air entering the air inlets 31. Note that damper plate 31*a* can be adjusted to control the volume of inlet air. It should be further noted that air inlet 31 could be a venturi to also compliment intake air velocity.

Lighter particles 12*b* will be lifted into upper classification chambers such as 21 while heavier particles 12*a* will tend to resist the lifting action of the air flow and end up in lower classification chambers such as 26. It is even possible that larger particles 12c will totally resist being lifted and continue to remain in the reduction chamber until the particle is reduced in size and finally lifted to a classification chamber.

In reference to FIG. 2, there is shown capital letters A, B and C in the classification chamber area 18. Tests have been made of air velocity in feet per minute at the three points while using three different impact rotor speeds in revolutions in feet per minute. The results are as follows:

| Revolutions in feet per minute | Air Velocity in feet per minute | | |
|---|---|---|---|
| | A | B | C |
| 7,100 | 850 | 1,500 | 1,625 |
| 8,900 | 1,000 | 1,700 | 2,000 |
| 10,900 | 1,400 | 1,900 | 2,300 |

Figure 3:
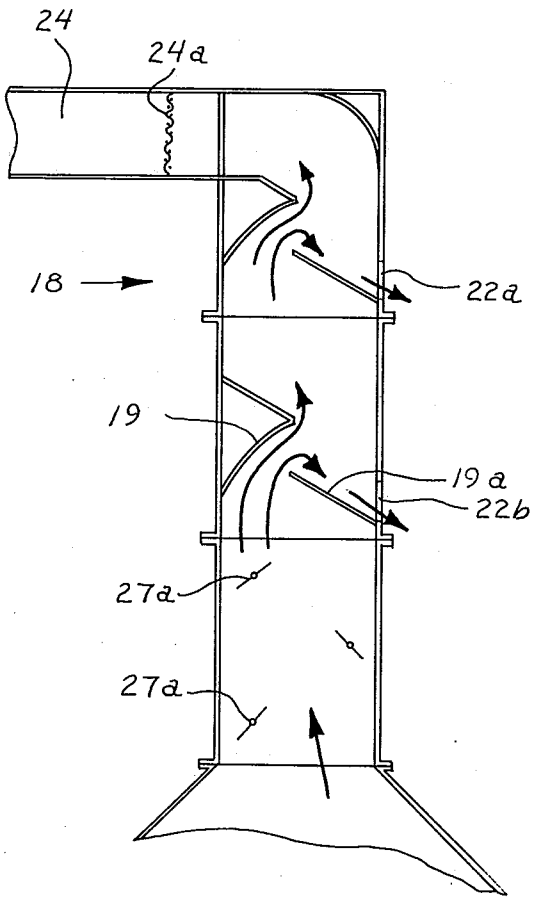
FIG. 3 is a front cross section of the classification area of the mill.
Figure 4:
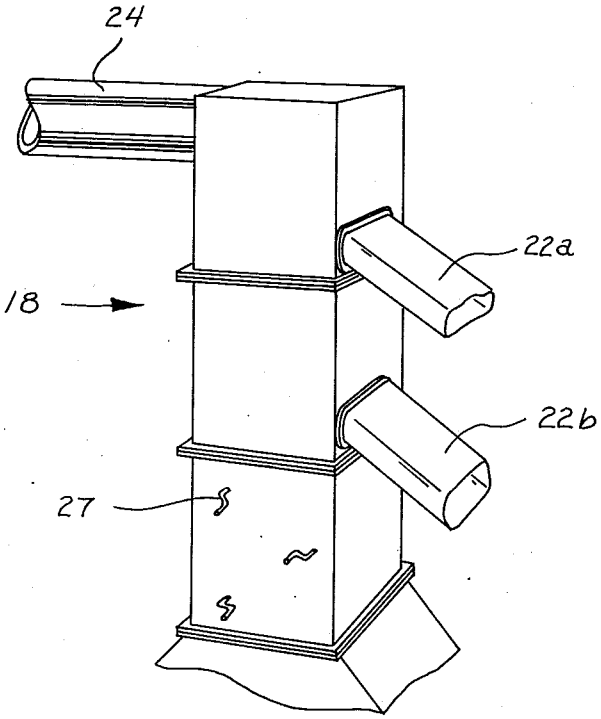
FIG. 4 is a perspective view of the classification area of the mill.

Classification chambers 21 and 25 each has an outlet chute 22a, 22b, FIGS. 3 and 4.

The flange fastening system can comprise cooperative holes for bolts 23a, FIG. 2, regardless of which direction the chamber outlet is facing.

Each outlet chute contains a screen 28 which can further select particle size thereby excluding particle sizes which are slightly larger than desired. The screen is found to be most effective when it is positioned precisely transverse to the airflow from the impact reduction chamber and therefore a plurality of adjustment stops 28a are provided together with a lower screen rest 28b with a plurality of positions. By selecting between the positions on the screen rest 28b and adjustment stops 28a it is possible to position a screen 28 for maximum transversity to the then occurring airflow. A screen access door 28c is necessary so that the screen may be removed and replaced readily. Note that the classification chambers contain internal air deflector flaps 27a, controlled by external handles 27. These flaps are important in directing the stream of flow of both air and particles.

In reference to the "flow" arrows shown in FIG. 3, it can be seen that diverter plate 19 cooperates with the inner outlet chute 19a so as to aid in deflecting materials on to the inner outlet chute thereby assisting in the discharge of particles. Also, an additional outlet could be connected from the top classification chamber to a source of suction 24 and/or to a dust deposit chamber. A particle sizing screen 24a could be inserted in the upper duct.

On each side of the mill there is an air inlet tube 31 which contains a damper control 31a to control the volume of air entering the mill. If desired, the air inlet could be of a venturi type construction so that air velocity could also be controlled. Note that the air inlets 31, only one is shown, are housed in an access door 32 for accessibility to the air inlet and also to the interior of the mill.

If has been found, however, that there is a tendency for material to pack in the area of the primary reduction chamber which is directly below the impact rotor. The flow of air through the air inlets 31 helps to relieve this tendency to pack and causes the material to flow properly and to then proceed through the complete disintegration as heretofore described.

FIGS. 2 and 1 illustrate a fluidizing rotor unit 70 which is located in a well 75 directly below the impact rotor 60. As previously mentioned, material has a tendency to pack in the well area and this is why the fluidizing unit is so positioned. The fluidizing rotor unit is simply a shaft 71 which has removable bars or fins 72 attached thereto, the removable bars or fins paralleling the length of the shaft.

The fluidizing rotor unit is driven by drive motor 50 via belts 52 and 53. In this configuration the impact rotor 60 and the fluidizing rotor 70 rotate in the same direction. After use, the bars or fins 72 will wear on the side where impact takes place and by reversing the direction of rotation of the fluidizing rotor, it is possible to expose the opposite sides of the bars or fins thereby extending the time of use. Reversal is possible in different ways. Pulleys 61a, 71a could be such that belt 53 could be twisted when it was desired to rotate the fluidizing unit in the opposite direction. Also, a reversible drive gear box assembly 51 could be used in conjunction with belts 54, 55 shown in phantom, then by removing belt 53. If it were necessary to rotate the impact rotor in the opposite direction, belt 52 could be eliminated while belts 54, 55 and 53 would be used. Naturally, reversing the direction of rotation of the drive motor, or twisting of belt 53 would also suffice. Being able to reverse direction of rotation of the fluidizing unit is a desired advancement in the art.

Figure 6:
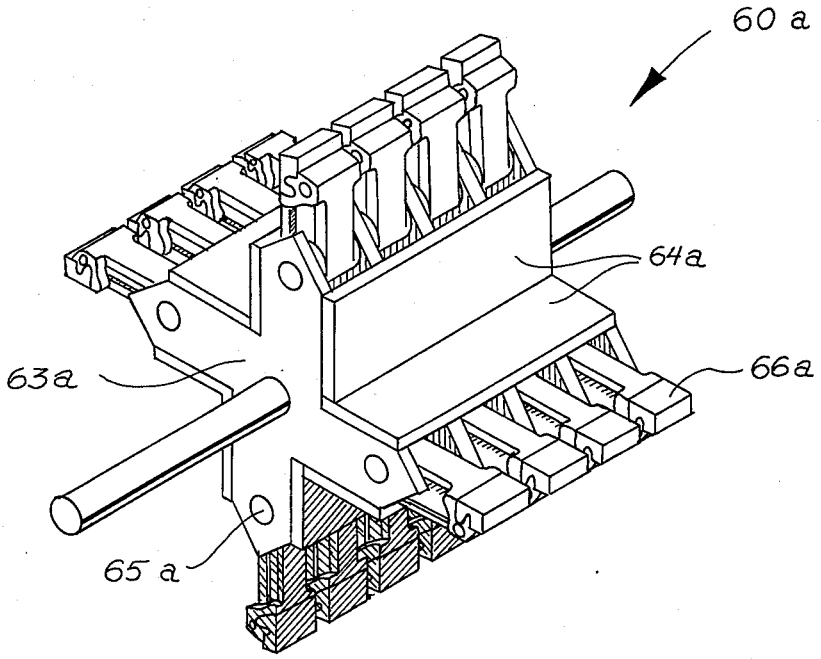
FIG. 6 is an exploded perspective view of an impact rotor which can alternatively be used with this embodiment.

FIG. 6 is an alternate embodiment of the rotor for use in this device. In this case, the rotor is generally indicated as 60a, the elements of FIG. 5 being compared thereto, show the blades 63 in a different form essentially the form of an offset cross 63a, and the intermediate plate to aid in the airflow shown as 64a with the shafts for the impact bars 66a being shown by the numeral 65a.

While the embodiment of this invention, shown and described, is fully capable of achieving the objects and advantages desired, it is to be understood that the embodiments shown have been for purposes of illustration only, and not for purposes of limitation.

I claim:

1. The improvement in a mill for the crushing and classification of materials comprising: the combination with a housing and drive motor of the following: an intake chute interconnecting with an impact reduction chamber within said housing; an impact rotor connected to said motor and mounted within said impact reduction chamber such that upon rotation of said impact rotor a verticle airflow is produced within said impact reduction chamber; a plurality of impact hammers mounted upon said impact rotor, extending outward from the periphery of said impact rotor; a motor driven reversible fluidizing rotor being located in said reduction chamber directly beneath said impact rotor to prevent materials from accumulating under said impact rotor; at least one classification chamber positioned directly above said impact reduction chamber with open interior communication between said impact reduction chamber and said classification chamber; means within the classification chamber to control the velocity of said vertical air flow caused by the rotation of said rotor; means within the classification chamber to gather materials of a predetermined size which are lifted by said vertical airflow; means cooperative with and connected to the classification chamber for the purpose of exiting the materials from the classification chamber; and means within the classification chamber to direct the movement of vertical airflow within the mill.

2. The mill of claim 1 wherein the velocity of said vertical air flow is controlled by said impact rotor speed.

3. The mill of claim 1 wherein the velocity of said vertical air flow is controlled by regulating the amount of air entering the mill at outside air vents located in the impact reduction chamber.

4. The mill of claim 1 wherein the means for gathering materials of a predetermined size includes a diverter assembly and an interior chute.

5. The mill of claim 1 wherein the means to exit materials from the classification chamber includes an outlet chute and an adjustable screen.

6. The mill of claim 1 wherein the means to direct the movement of vertical air flow within the classification chamber is by use of internal deflector blades.

* * * * *